United States Patent [19]

O'Connor et al.

[11] Patent Number: 5,076,128

[45] Date of Patent: Dec. 31, 1991

[54] DIE CUTTER BLANKET

[76] Inventors: Barry J. O'Connor; Robert B. Vigder, both of, c/o Corfine, Inc., 5918 Kilgore Ave., P.O. Box 2525, Muncie, Ind. 47302

[21] Appl. No.: 515,005

[22] Filed: Apr. 26, 1990

[51] Int. Cl.[5] ..... B26D 7/20

[52] U.S. Cl. ..... 83/659; 83/347; 83/698

[58] Field of Search ..... 83/658, 659, 512, 347, 83/698; 101/415.1; 403/381, 353; 24/573.1, 587

[56] References Cited

U.S. PATENT DOCUMENTS

| | | | |
|---|---|---|---|
| 2,820,409 | 1/1958 | Johnson | 101/415.1 |
| 3,885,486 | 5/1975 | Kirkpatrick et al. | 83/347 |
| 4,073,207 | 2/1978 | Kirkpatrick | 83/659 |
| 4,848,204 | 7/1989 | O'Connor et al. | 83/659 |

*Primary Examiner*—Mark Rosenbaum
*Assistant Examiner*—Allan M. Schrock
*Attorney, Agent, or Firm*—Biebel & French

[57] ABSTRACT

A replaceable cover for the cylindrical anvil of a rotary die cutter includes a blanket body of elastically deformable material, a sheet metal liner for the blanket body, and a latch assembly for securing the ends of the cover together in a lengthwise slot in the face of the anvil roll. This cover is particularly designed for use with a prior art anvil roll wherein the slot in the face of the roll has opposed parallel sides which extend at right angles to the bottom of the slot, and each of which is provided with a groove along its lower edge that forms an extension of the slot bottom. The latch assembly includes a channel member having one side secured to one end of the blanket liner so that the open side of the channel faces the other end of the blanket body for interlocking cooperation with a latch member integrally formed on the other end of the blanket body. The radially inner side of this channel member is sufficiently wider than the slot in the anvil roll so that its edge extends into one of the grooves in the corners of the slot in the anvil roll in the assembled condition of the latch assembly.

6 Claims, 1 Drawing Sheet

DIE CUTTER BLANKET

BACKGROUND OF THE INVENTION

This invention relates to a blanket assembly for use as a replaceable cover for the cylindrical anvil of a rotary die cutter or the like to support the sheet or web material being cut by the die or dies carried by the complementary rotary die cylinder, as shown, for example, in our U.S. Pat. No. 4,716,802. The invention has particular relation to a new and improved latch mechanism for securing a die cutter blanket of urethane or other elastically deformable material to a rotary die cutter anvil roll of special construction different from the anvil roll shown in our U.S. Pat. No. 4,848,204.

More specifically, the primary object of the present invention is to provide replacement blankets for use on an anvil roll of a prior art construction illustrated in FIGS. 1 and 2. As shown in those views, the replaceable blanket 10 is mounted on a composite anvil roll comprising an annular metal head 11 surrounded by a two-piece slip bearing 12 of a hard polyurethane although it could also be of metal, and for the purposes of the present invention, the bearing 12 could be integral with the head 11.

In this prior art construction, the bearing 12 is provided in its outer surface with a slot 13 of generally channel shape having opposed parallel side walls 14 and 15 and a flat bottom 16 extending from end to end of the roll parallel with its rotary axis. In addition, each of the side walls 14 and 15 of the slot 13 is provided with a groove 18 along its inner edge which in effect increases the width of the slot bottom 16 and is overhung by the adjacent slot wall 14 or 15.

The blanket cover 10 is molded of elastically deformable urethane, and a sheet metal liner 20 is adhered to its radially inner surface. The opposite ends of this liner 20 carry the complementary members of a latch assembly designed for interlocking engagement within the slot 13. The latch member 22 is riveted to one end of the liner 20 and is of generally channel shape in cross-section proportioned for endwise insertion in the slot 13. The member 22 is provided along its outer edges with rib portions 23 proportioned to be received in the grooves 18 in the side walls of slot 15. The elastomeric material of the blanket 10 extends into a minor portion of the interior of the member 22 and is configured to provide a shoulder 23 facing the bottom wall of member 22.

In use, due to the grooves 18 in slot 13 and ribs 23 on channel 22, the channel must be inserted endwise into the slot 13 and is thereby anchored in the slot before installation of the blanket assembly is completed. The complementary part of the latch assembly is a metal bar 25 riveted to the opposite end of the liner 20 and having its back edge and a portion of its underside covered with a layer 26 of the material of the blanket 10. The outer edge of the bar 22 projects beyond the adjacent end of the liner 20 and the blanket 10, and the bar 25 and its urethane cover 26 are proportioned as a whole so that the projecting edge of the bar will hook under the shoulder 23, and its covering 26 can then be forced into the member 22 to complete the latched engagement.

SUMMARY OF THE INVENTION

The primary object of the present invention is to provide a latch assembly for the ends of a blanket for use as a replacement cover for the anvil roll of a rotary die cutter which is equipped with a slot of the configuration described above in connection with FIGS. 1 and 2, but which is of very much simpler and less expensive construction than the latch assembly described in connection with FIGS. 1 and 2.

The particular structure by which this objective is achieved is described in detail in connection with the preferred embodiment of the invention, wherein additional features and advantages provided by the invention are also pointed out.

DESCRIPTION OF THE PREFERRED EMBODIMENT

Figure 1:
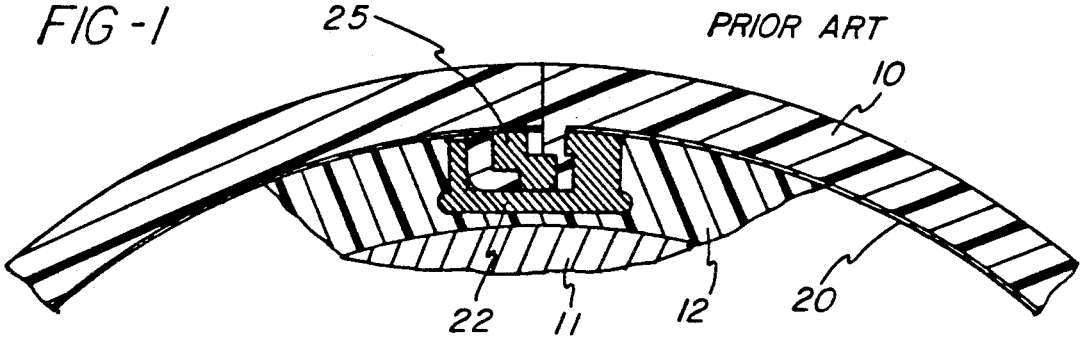
FIG. 1 is a fragmentary view in radial section through the outer surface portion of an anvil roll provided with a replaceable blanket having complementary latch members on each end thereof in accordance with the prior art.

As already pointed out, the primary purpose of the present invention is to provide a blanket assembly which can be substituted for the prior art assembly as described above in connection with FIGS. 1 and 2, so that it can be used as a replacement for the blanket shown in FIGS. 1 and 2. The blanket body 30 of elastomeric urethane has a sheet metal liner 33 bonded to its radially inner surface, and one end of the liner 33 extends to the end of the urethane body and has bonded thereto a metal channel 35 which forms the female end of the latch assembly. The channel 35 has a radially outer wall 36 which is welded to the liner 33, and a substantially wider radially inner side wall 37 which is so proportioned that when the base wall 38 of the channel abuts the side wall 14 of the slot 13, the channel wall 37 will extend the full width of the slot 13 and into the groove 18 in the slot wall 15.

The interior of the channel 35 is partially filled with the same urethane material 40 of which the blanket 30 is composed, and is preferably connected with the blanket 30 through aligned holes in the channel wall 36 and the portion of the liner 33 to which this channel wall is secured. This urethane material 40 fills approximately one-half of the volume of the slot 13 and is configured to expose a strip 41 extending along the end of the radially inner surface of the liner 33. The remainder of this polyethylene portion 40 is configured with an inclined exposed surface 42 facing radially outwardly when this end of the blanket assembly is installed in the slot 13.

Figure 3:
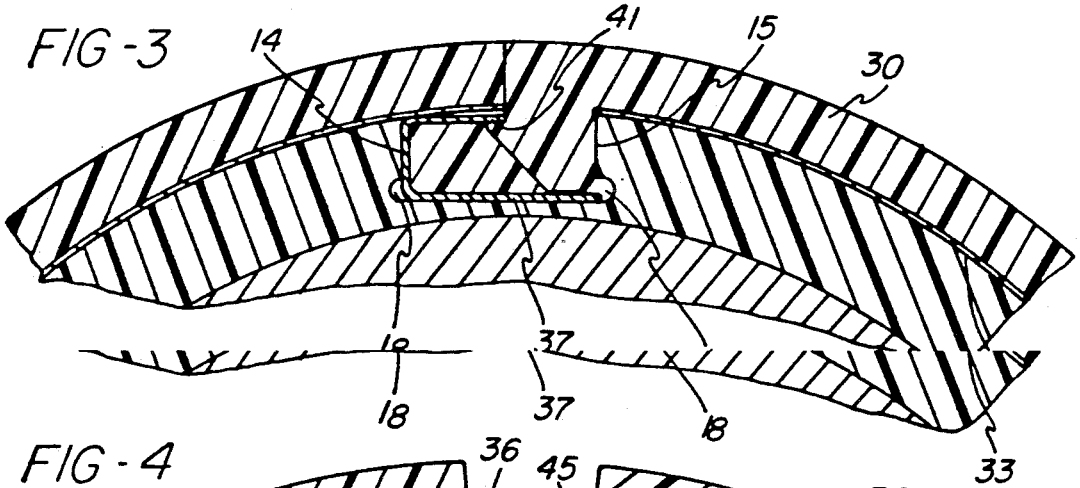
FIG. 3 is a view similar to FIG. 1 wherein the blanket is equipped with latch members in accordance with the present invention.
Figure 4:
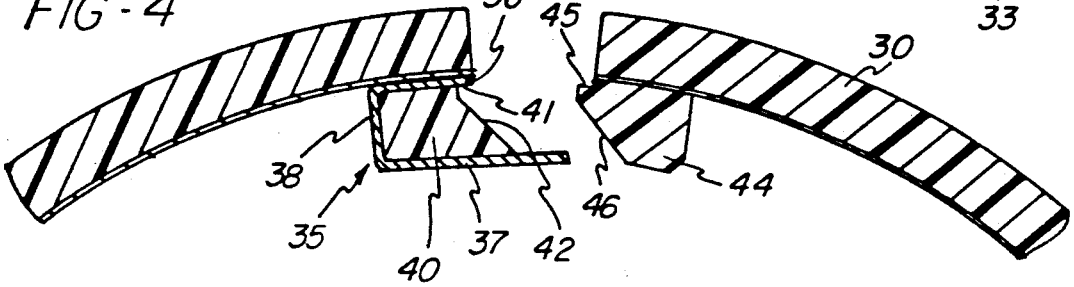
FIG. 4 is a view similar to FIG. 2 illustrating the opposite ends of a blanket in accordance with the invention.

The other end of the blanket 30 includes a male latch member 44 which is of the same material and integrally molded with the blanket body 30. This latch member 44 covers and overhangs the adjacent end of the liner 33 and is proportioned to fill the entire portion of the slot 13 which remains open after the channel 35 has been inserted therein. Thus as shown in FIGS. 3 and 4, this latch portion 44 includes a lip 45 extending along its outer edge which fits under and engages the exposed strip 41 along the edge of the liner 33. The latch member 44 also includes a beveled surface 46 complementary to the surface 42 on the urethane 40 inside channel 35.

Figure 2:
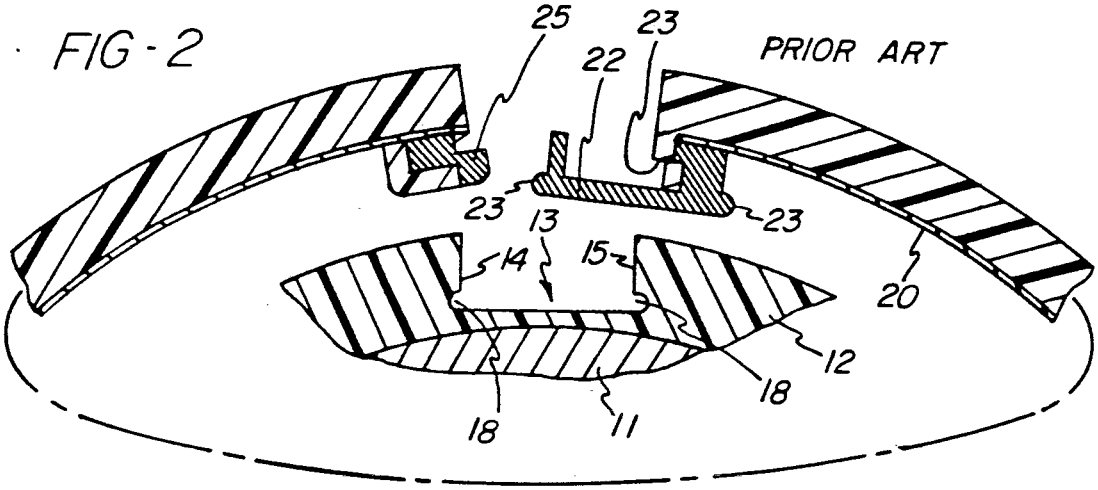
FIG. 2 is a similar view showing the opposite ends of the blanket apart from the anvil roll.

In the use of the invention, it is assumed that one of the blanket assemblies of the invention is to be installed in place of a blanket assembly as shown in FIGS. 1 and 2, the removal of which requires that its latch member 22 must be moved lengthwise thereof out of the slot 13. However, mounting of the replacement blanket of the invention does not require movement of any part axially of the roll, because the channel 35 can be inserted into the slot 13 by movement in a direction lengthwise of the blanket which is generally radially of the roll, so that the side edge of the channel wall 37 enters the groove 18 in the slot wall 15, after which the remainder of the channel 35 will in effect pivot into the remainder of the slot 13.

Since the edge of the channel wall 37 will then remain within the groove 18, this will prevent the channel from coming out of slot 13 while the remainder of the blanket assembly is wrapped around the roll until its latch portion 44 is introduced into the empty portion of the slot 13. This end of the blanket is then pounded until the lip 45 enters the slot 13 and latches under the edge strip 41 of the liner 33 to complete the latched engagement between the two ends of the blanket.

It will accordingly be seen that the replacement blankets of the invention provide significant advantages over the prior art construction in simplicity of construction, and hence in cost, as well as in application. More specifically, if the blanket of the prior art is used in conjunction with an anvil roll provided with end rings for holding the blanket in place axially of the roll, one such ring must be removed and replaced as part of the blanket changing operation. Also, it is always necessary with the prior art construction that there be space at one end of the roll to accommodate the full width of the blanket while its latch member 22 is moved endwise into or out of the slot 13. In contrast, the blanket of the invention can be mounted on the same anvil roll by simple movement toward or away from the roll axis and with no axial movement of the blanket, so that if there are end rings on the roll, they do not need to be removed.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. A replaceable blanket for an anvil roll for rotary die cutting having a cylindrical periphery which is provided with a slot of channel shape having opposed parallel flat sides and a flat bottom extending from end to end of the roll parallel with the rotary axis of the roll, and wherein one of said slot sides is provided along the inner edge thereof with a groove which increases the width of said slot bottom and is overhung by said slot side, comprising:

(a) a blanket body of elastically deformable material proportioned to fit around the anvil and having radially inner and outer sides and opposed ends which meet each other to define a cylindrical sleeve in a mounted position of said blanket body on an anvil roll, (b) means at the radially inner surface of one end of said body defining a channel including a base wall and radially inner and outer side walls generally parallel with said body and having the open side thereof facing away from said body, (c) said radially inner channel wall being of a width sufficiently greater than the distance between said slot sides that upon insertion of said channel in said slot with said base wall thereof abutting the side of said slot opposite said grooved side of said slot, the edge of said channel inner wall will extend into said groove to hold said channel in said slot, (d) said radially outer channel wall being of less width than said radially inner channel wall to provide a space between said radially outer wall and said grooved side of said slot when said channel is received in said slot, (e) the other end of said blanket body including a latch of said elastically deformable material extending radially inwardly thereof and proportioned to be received through said space into said slot, and (f) said latch including a lip portion proportioned to extend within said channel into interlocking engagement with the inner surface of said radially outer channel wall.

2. A replacement blanket as defined in claim 1 further characterized by said latch being proportioned to fill only a portion of said channel, and said one end of said blanket body including a portion of said elastically deformable material extending radially inwardly thereof and proportioned to fill the portion of said channel which is not filled by said latch.

3. A replacement blanket as defined in claim 1 wherein said blanket includes a sheet metal liner secured to the radially inner surface of said elastomeric blanket body, said channel is secured to the radially inner surface of one end of said liner, and said latch covers and overhangs the other end of said liner.

4. A replacement blanket as defined in claim 1 wherein said channel is partially filled with said elastically deformable material which is configured to expose a strip along the radially inner surface of said radially outer channel wall while leaving a substantial portion of said slot empty when said channel is inserted in said slot, and wherein said latch is configured to fill said empty portion of said slot when said lip portion engages said exposed strip of said radially outer channel wall.

5. A replacement blanket as defined in claim 4 wherein said blanket includes a sheet metal liner secured to the radially inner surface of said elastomeric blanket body, said channel is secured to the radially inner surface of one end of said liner, and said latch covers and overhangs the other end of said liner.

6. A replacement blanket as defined in claim 5 wherein said elastomeric material within said channel has a beveled surface facing outwardly of said slot when said channel is inserted in said slot, and said latch has a beveled surface complementary to and engaging said beveled surface on said elastomeric material in said channel.

* * * * *